United States Patent [19]

Venditti et al.

[11] Patent Number: 4,478,138

[45] Date of Patent: Oct. 23, 1984

[54] SUPPLEMENTAL COOLING SYSTEM

[75] Inventors: Paul L. Venditti, St. Clair Shores; Harmon S. Bayer, West Bloomfield, both of Mich.

[73] Assignee: Winteraire, Inc., Detroit, Mich.

[21] Appl. No.: 431,699

[22] Filed: Sep. 30, 1982

[51] Int. Cl.[3] ..... F24F 13/00

[52] U.S. Cl. ..... 98/33 R; 137/613; 62/412

[58] Field of Search ..... 137/613, 338; 62/332, 62/412; 98/33 R, 41 R

[56] References Cited

U.S. PATENT DOCUMENTS 4,073,224 2/1978 Bierlich ..... 98/41 R 4,178,770 12/1979 Fox ..... 62/332 X

*Primary Examiner*—William E. Wayner

*Attorney, Agent, or Firm*—Cullen, Sloman, Cantor, Grauer, Scott and Rutherford

[57] ABSTRACT

An apparatus for cooling an enclosure uses cold ambient air drawn into the enclosure by an intake blower through a filter and an intake valve. An exhaust blower simultaneously draws air from inside the enclosure through an exhaust valve and a filter before exhausting the air. The intake and exhaust blowers are switched on and the intake and exhaust valves are opened when the ambient air is cooler than the enclosure and the enclosure requires cooling to remain within an acceptable temperature range. Condensation on the valves is eliminated by making the valve bodies from an insulative material and by attaching insulation to the valves. Two element valves are disclosed which trap a pocket of air in the valve for insulating opposite ends of each valve from one another. A warm air blower inhibits condensation formation on the ambient air side of the valve when closed by warming the surface of the valve element. Intake and exhaust filters prevent foreign material from entering the enclosure. The filters are mounted in housings located in the intake and exhaust portions of the system and have a large cross-sectional area for reducing the restriction of air flow caused by the filter. The filter is mounted in a cartridge to be easily changed in the housing. Primary and secondary screens are attached to the exterior ends of the system to prevent insects and rodents from entering the system.

3 Claims, 8 Drawing Figures

SUPPLEMENTAL COOLING SYSTEM

BACKGROUND OF THE INVENTION

1. Technical Field

The present invention is related to a supplemental cooling system for cooling with ambient air a mechanically refrigerated container or "cold box". More specifically, the supplemental cooling system is alternatively used to cool the box in place of the independently operated mechanical refrigeration system.

2. Prior Art

Supplemental cooling systems which use cool ambient air, when available, to cool a refrigerated box instead of using the refrigeration system are known in the prior art. Supplemental cooling systems are able to significantly reduce the amount of energy required to cool an enclosure. However, several problems have been encountered in the use of prior art supplemental cooling systems.

One problem with prior art systems is the need to interface the supplemental cooling system with the normal refrigeration equipment. Such interfacing generally requires wiring the supplemental system to the refrigeration equipment so that the refrigeration equipment does not operate while cool air is available to the supplemental cooling system. When prior art supplemental cooling systems are retrofitted to preexisting refrigeration systems, problems are often encountered due to the need to interface with many different types of refrigeration equipment. This is time consuming and requires analysis of the refrigeration system electrical controls. If the wiring is incorrectly performed the refrigeration equipment can be adversely affected which could result in damage to the refrigerated products or the refrigeration system.

Another problem that has faced prior art supplemental cooling systems is the accumulation of condensation in the system when it is not in use. Condensation is undesirable since it facilitates the formation of mildew and bacteria which is not acceptable in cold storage facilities where sanitation is important. Condensation is formed when cool refrigerated air on one side of a vent or valve cools the vent or valve and warm humid ambient air contacts the other side of the vent or valve causing the moisture in the ambient air to condense on the cool surface.

Another problem with prior art supplemental cooling systems is that they do not adequately prevent particulate matter, dirt and debris from being drawn into the enclosure with the cool air. In particular, fine particulate matter or smoke have not been removed or detected by prior art systems.

In prior cooling systems insects and rodents have been either pulled into the intake or have crept into the intake or exhaust vents. Supplemental cooling systems require direct venting from the exterior of a building to the cold storage enclosure. The vents of prior supplemental cooling systems provide avenues of entry to the cold storage enclosure for such life forms. This problem precluded the use of auxiliary cooling systems in many sanitary installations.

SUMMARY OF THE INVENTION

The supplemental cooling system of the present invention provides cold ambient air, when available, to a cold storage enclosure that is suitable for use in sanitary cold storage applications because it prevents both the formation of condensation in the apparatus and entry of foreign matter into the enclosure.

Moisture resulting from condensation is eliminated in the present invention by various means including constructing the apparatus almost entirely from insulative material, which reduces heat transfer through the device. The formation of condensation in the intake and exhaust valves is further reduced by applying additional insulation to the valve element and valve seat to insulate the side of the valve exposed to refrigerated air from the side exposed to warm ambient air. The temperature differential at the valve is also reduced by the use of a unique dual element valve in which a pocket of air insulates the refrigerated side of the valve from the side of the valve in contact with ambient air.

According to one embodiment of the present invention, an auxiliary blower may be directed at the valve element exposed to humid ambient air to evaporate any accumulation of condensation. The auxiliary blower may also be provided with a heating element to warm the valve element to prevent condensation from forming.

The air supplied by the supplemental cooling system of the present invention is filtered and screened to be both clean and sanitary. Air drawn from the outside is filtered to remove dust and fine particulates. A primary and secondary screen are provided at the exterior ends of the system where air is drawn from or exhausted into the ambient air. The primary screen is a fine mesh screen which prevents entry of insects. A secondary screen comprising a coarse screen is provided adjacent the primary screen for excluding larger rodents and supporting the primary screen.

Air filter elements are provided in both the intake and exhaust portions of the system to prevent entry of foreign material into the enclosure. The air filters of the present invention are high efficiency cartridge type air filters having a greater cross-sectional area than the other parts of the system to prevent static pressure build-up in the system. The air filters are of the cartridge type to be easily replaced for maintaining the high efficiency of the system.

One feature of the present invention is that installation of the apparatus does not require electrical interfacing with the primary refrigeration equipment of the enclosure. Control of the supplemental cooling system is simply achieved by the use of two thermometers, one inside the enclosure and one exposed to the ambient air. Interface with the refrigeration control is not necessary since the enclosure temperature may be set so that the supplemental cooling system is enabled at a slightly lower temperature than the refrigeration system when the ambient air is sufficiently cooled to permit use of the supplementary cooling system.

Another feature of the present invention is the inclusion of a smoke detector for shutting off the supplemental cooling system if smoke is drawn into the enclosure from external sources or originates within the enclosure. If a limited amount of smoke is drawn into the system a significant portion will be filtered out by the filter element. However, if unacceptable amounts of smoke accumulate in the enclosure the smoke detector is effective to prevent damage to products in the enclosure by interrupting the operation of the supplemental cooling system and activating an alarm.

DETAILED DESCRIPTION

Figure 1:
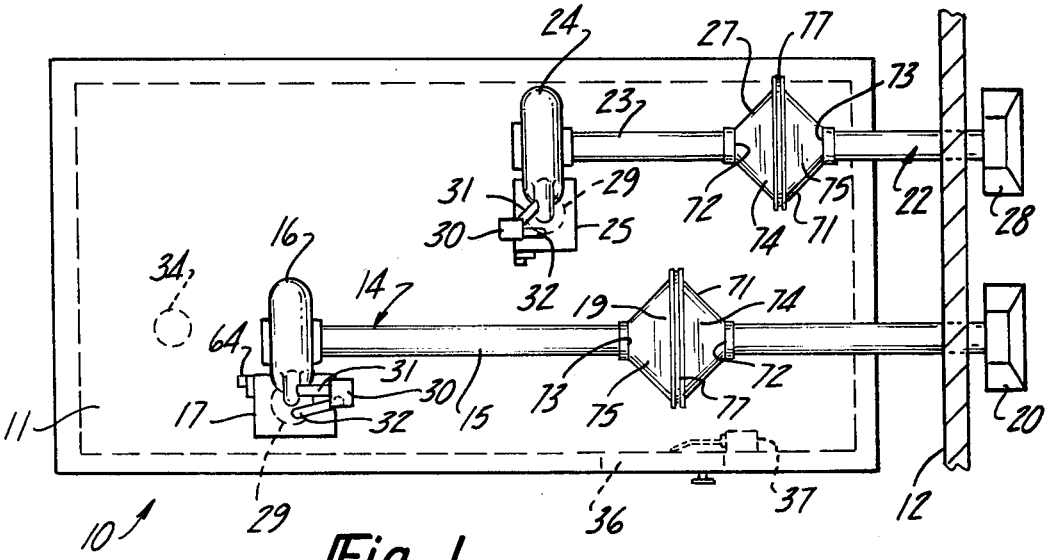
FIG. 1 is a plan view of the supplementary cooling system of the present invention.
Figure 2:
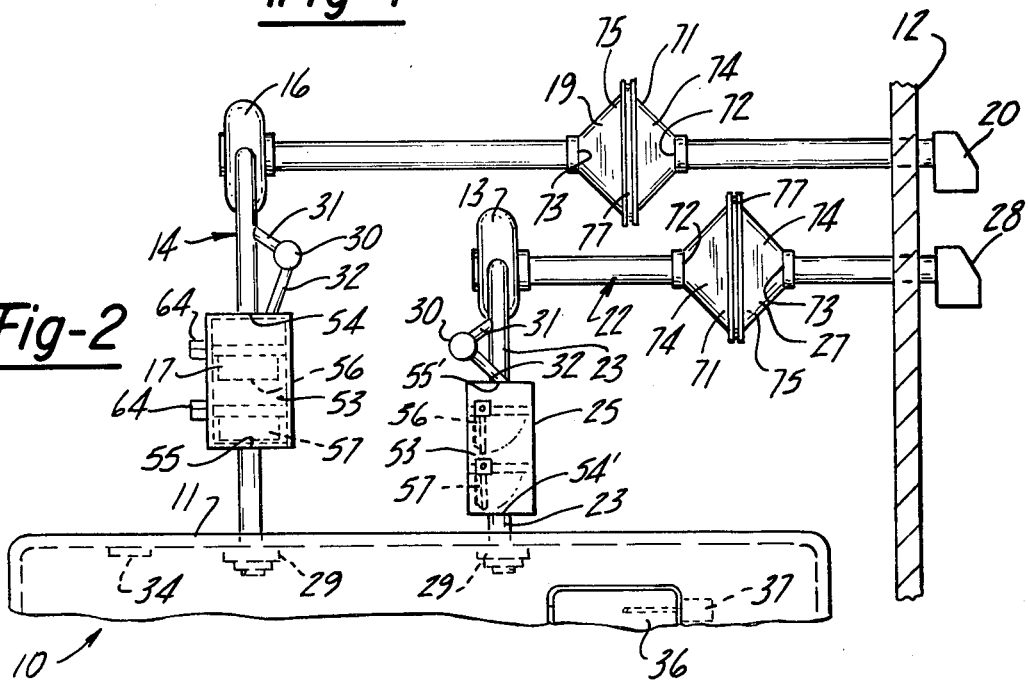
FIG. 2 is an elevational view of the supplementary cooling system as shown in FIG. 1 with the enclosure partially cut away.

Referring now to FIGS. 1 and 2, a cooling system is generally indicated by the reference numeral 10. The cooling system is used to cool a box-like enclosure 11 that is located within a building 12.

The cooling system 10 comprises an air intake system 14 for drawing cool air from outside the building 12 into the enclosure 11. The intake system 14 includes piping 15 running from outside the building 12 into the enclosure 11. The piping 15 is preferably made from polyvinyl chloride (PVC) for its desirable low heat transfer characteristics, although other commercially available materials may be used.

Air is pumped through the intake system 14 by means of a blower 16 which is attached intermediate the piping 15. A valve unit 17 is mounted in the piping 15 between the enclosure 11 and the blower 16 to selectively prevent the flow of air through the intake system 14. A filter unit 19 is also included in the air intake system and is connected to the piping 15. The filter unit 19 is preferably located upstream from both the blower 16 and valve unit 17 to prevent foreign material from reaching the blower 16 and valve unit 17. A vent hood 20 is provided at the end of the piping 15 extending from the building 12 to shield that end and prevent foreign material from entering the intake system 14. An air diffuser grill 29 is provided on the opposite end of the piping 15 which opens into the enclosure 11 to diffuse the air introduced by the intake system.

An exhaust system 22 is provided to withdraw air from the enclosure 11 as the intake system 14 draws cold air into the enclosure 11. Similar to the intake system 14, the exhaust system 22 includes piping 23 that is connected to a blower 24 which forces air from the enclosure 11 to the outside of the building 12. A valve unit 25 is also included in the exhaust system to prevent movement of air through the exhaust system when the cooling system 10 is not operating. The exhaust system 22 may also include a filter unit 27 which acts to filter air that may seep into the piping 23 when the system is not operational. The end of the piping 23 extending out of the building 12 is provided with a vent hood 28 to prevent foreign material from entering the exhaust system 22. An air diffuser grill 29 is mounted on the end of the piping that opens into the enclosure to cover the end of the piping 23.

The cooling system 10 may be used on refrigerated enclosures used to hold food or other products requiring a sanitary environment. Mechanical refrigeration systems used on cold boxes generally recirculate the air within the cold box. Such systems are therefore substantially sealed from contaminants and humidity found in ambient air. Since the cooling system 10 of the present invention circulates cool ambient air through the enclosure, contaminants and condensation in the system must be avoided if it is to be used with cold boxes requiring sanitary conditions.

In sanitary environments it is generally desirable to prevent the accumulation of condensation. In cooling systems condensation can form at any place that warm moist air comes in contact with a surface that is cooler than the air. When the cooling system 10 is not in operation the valve units 17 and 25 are closed to prevent the escape of refrigerated air through the system. The valve units are preferably provided between the enclosure and the blower to minimize the volume of air that must be cooled on the enclosure side of the valve by the refrigeration system when the supplemental cooling system 10 is not in use. When the valve units 17 and 25 are closed, the refrigerated air on the enclosure side of the valve has the potential to cool the valve and create a cool surface upon which moisture in warm ambient air may condense and accumulate in the system. The structural parts of the valve units 17 and 25 are constructed of PVC or are otherwise insulated to reduce heat transfer therethrough.

In humid environments it may be necessary to include a condensate blower in the system that is effective to evaporate any condensation forming on the valve units 17 and 25. The condensate blower 30 is a small low horsepower blower that withdraws air from the piping 15 or 23 through a shunt opening 31 and blows it through a port 32 formed in the upstream end of the valve unit 17 and the downstream end of the valve unit 25. The condensate blower 30 may also include a heating element to warm the air blown into the valve which in turn increases evaporation and warms the parts of the valve that may be cooled by the refrigerated air emitted from the enclosure 11.

As a further sanitation and safety feature, a smoke detector 34 may be mounted on the ceiling of the enclosure 11 to detect the presence of smoke in the enclosure 11. Smoke may be introduced into the enclosure by either a fire in the enclosure or a fire in the vicinity of the building 12. In the unlikely event that a fire should start inside the enclosure it is desirable to shut down the cooling system 10 to seal off the enclosure and extinguish the fire. Likewise, if a fire causes smoke in the vicinity of the building 12 that is drawn in by the intake system 14 it is desirable to turn off the cooling system 10 to prevent smoke from harming products stored in the enclosure 11.

The enclosure 11 is provided with a door 36 or other type of access cover. When the door 36 is open it is generally preferable to turn off the cooling system to prevent frigid air from being pumped into the building. A limit switch 37 is used to monitor the opening and closing of the door 36.

Figure 3:
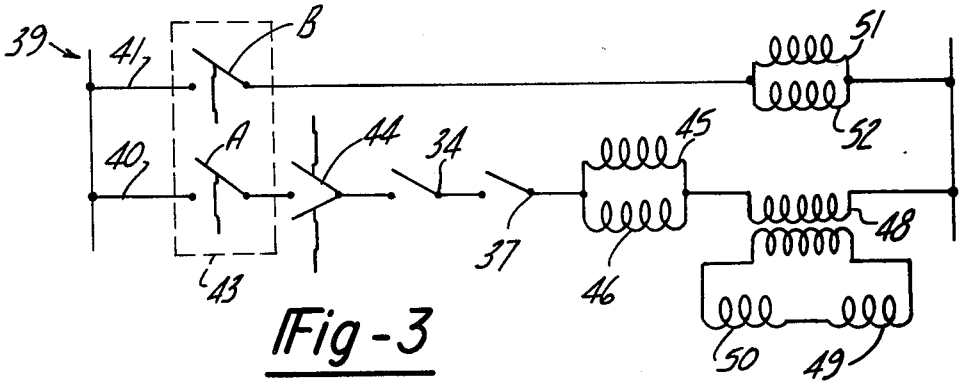
FIG. 3 is an electrical schematic showing the controls for the supplemental cooling system.

Referring now to FIG. 3, the control circuit generally indicated by the reference numeral 39 is shown. The control circuit generally uses 120 volt alternating current and includes a cooling system circuit 40 and a condensate blower circuit 41. The cooling system circuit 40 controls both the intake system 14 and the exhaust system 22. The control system circuit 40 in the disclosed embodiment includes an exterior thermostat 43 for sensing the temperature outside the building 12 and the enclosure thermostat 44 for sensing the temperature inside the enclosure 11. Exterior thermostat 43 has a contact "A" which closes when the temperature outside the building 12 is cold enough to be useful for cooling the enclosure 11. In the disclosed embodiment the cooling system circuit includes the smoke detector 34 for shutting off the system upon sensing smoke inside the enclosure 11. The cooling system circuit 40 also includes the limit switch 37 to shut off the system when the door 36 is opened. The cooling system circuit 40 activates the intake and exhaust blower motors 45 and 46 which operate the blower 16 of the intake system 14 and the blower 24 of the exhaust system 22 respectively. The valve units 17 and 25 are operated on 12-volt DC power and require a transformer 48 to convert the 120 volt alternating current of the circuit to 12 volt direct current. The transformed current in turn operates at least one valve motor 49 in the intake system 14 and at least one valve motor 50 in the exhaust system 22.

The condensate blower circuit operates only when the cooling system 10 is not operating as a result of the air outside the building 12 being too warm to assist in cooling the enclosure 11. Each condensate blower 30 is positioned to blow air across the side of the valve unit 17 or 25 which is in contact with the ambient air when closed.

The condensate blower circuit 41 includes the exterior thermostat contact "B" and intake and exhaust condensate blower motors 51 and 52. Exterior thermostat contact "B" closes when the temperature outside the enclosure is above the temperature at which the cooling system is useable. Simultaneously, the exterior thermostat contact "A" in the cooling system opens to disable the cooling system circuit 40.

Operation of the supplemental cooling system 10 is dependent on the presence of a supply of cold outdoor air. Typically when the outside temperature is below 40° it will be used instead of the refrigeration system. In a typical installation, when the temperature outside the building drops to 40° or less the thermostat closes the contact in the cooling system circuit 40. If the enclosure 11 warms to the point that it requires additional cooling the contact of the enclosure thermostat in the cooling system circuit 40 closes. At this point the blower motor 46 is energized and the valve motors 49 are operated to move the valves into their open position. Air is then drawn through the outside intake vent, into the filter assembly to the blower, and pumped through the valve unit 17 and into the enclosure where it is diffused by the air diffuser grills. Meanwhile, the exhaust system pulls warm air out of the enclosure and prevents pressure build-up in the enclosure 11. When the enclosure is cooled to the lower limit of the safe temperature range the enclosure thermostat 44 opens the contact in the control system circuit to shut off the blower motors 46 and return the valve motors to their closed position.

The cooling system operates preferentially to and totally independently of the refrigeration system of the enclosure. The two systems do not require electrical interfacing since the enclosure thermostat 44 is preferred by setting it slightly lower than the thermostat which controls the refrigeration system. This allows the cooling system 10 to be switched on to cool the enclosure, unless the air outside the building is too warm to be of assistance for cooling purposes. In that case the existing refrigeration system operates to cool the enclosure.

The piping is preferably insulated by one and one half inches of fiberglass insulation, or other type of insulation, to prevent heat gain caused by heat transfer from the air inside the building 12 through the piping 15 that would reduce the effectiveness of the cooling system 10. Likewise, the air filter assembly, blower and valve unit are preferably insulated with fiberglass insulation.

The piping 15, 23 may be extended through either an exterior wall of a building or through the roof of a building depending upon the structure of the building 12.

Figure 4:
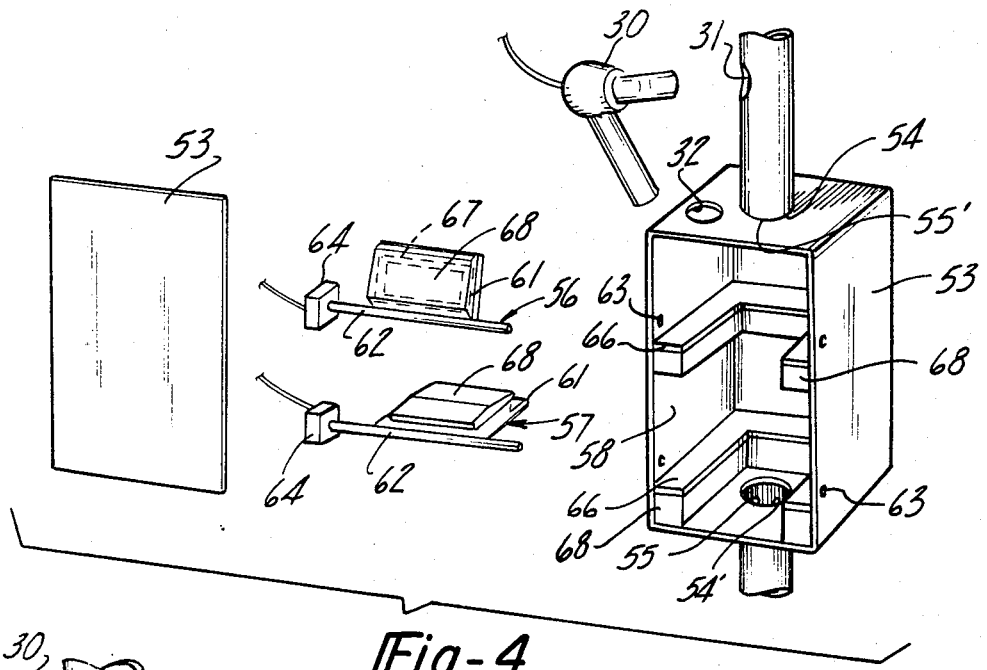
FIG. 4 is an exploded perspective view of the dual element valve and condensate blower.
Figure 5:
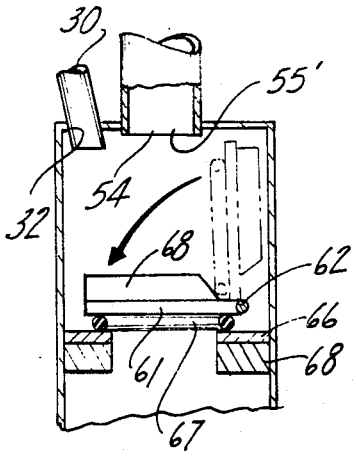
FIG. 5 is a partially cut away sectional view of one element of the valve in the closed position with the open position shown in phantom lines.

Referring now to FIGS. 4 and 5, valve unit 17 is shown in detail. Valve unit 17 includes a valve housing 53 comprising a rectangular box shaped member having an inlet port 54 at one end which is adapted to receive the piping 15 of the intake system 14. The opposite end of the valve housing 53 has an outlet port 55 for receiving another segment of the piping 15. Air enters the valve housing 53 through the inlet port 54 and exits the valve housing through the outlet port 55. In the disclosed embodiment the valve housing 53 includes first and second valves 56 and 57 which define an air lock or air pocket 58 therebetween when the first and second valves 56 and 57 are in their closed positions. The condensate blower 30 draws air through the shunt opening 31 in the piping 15 and blows air through the port 32 formed in the upstream end of the housing 53.

Each of the first and second valves 56 and 57 include a valve flap 61 which is a planar rectangular member mounted on a pivotable shaft 62. The shaft 62 is rotatably received in two openings 63 formed in the housing 53. A 12 volt DC reversible motor is mounted at one end of the shaft 62. The motor 64 is a quarter turn motor adapted to move the valve flap 61 90° from a closed position to an open position. As shown in FIG. 5, the valve flap 61 is in its closed position in which it lays against a valve seat 66. The open position is shown in phantom lines in FIG. 5. A gasket 67 may be included on the valve flap 61 to assure a tight seal between the valve seat 66 and the valve flaps 61. The tight seal between the valve seat 66 and valve flaps is important to prevent escape of refrigerated air from the enclosure to the outside when the cooling system 10 is not being operated.

Valve unit 25 is also described with reference to FIGS. 4 and 5 since it is substantially similar to valve unit 17. Valve unit 25 includes a valve housing 53 comprising a rectangular box shaped member having an inlet port 54' at one end which is adapted to receive the piping 23 of the exhaust system 22. The opposites end of the valve housing 53 has an outlet port 55' for receiving another segment of the piping 23. Air enters the valve housing 53 through the inlet port 54' and exits the valve housing 53 through the outlet port 55'. The valving mechanism is the same as that described above for valve unit 17 and therefore need not be repeated. The condensate blower 30 draws air through the shunt opening 31 in the piping 23 and blows air through the port 32 formed in the upstream end of the housing 53 and adjacent to the outlet port 55'.

Insulation 68 is attached to the valve flap 61 and valve seat 66 to limit or prevent condensation from forming on the valve. The insulation 68 reduces the tendency of the cool air inside the enclosure from cooling any part of the valve exposed to unrefrigerated air which could cause condensation to form.

Figure 6:
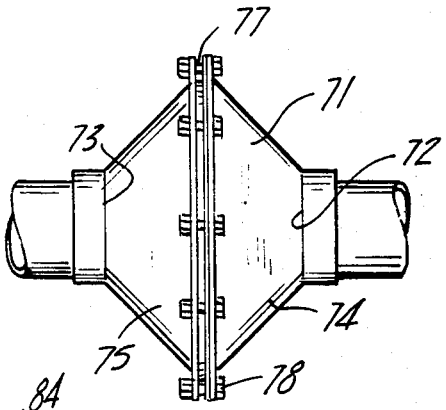
FIG. 6 is a elevation view of the filter housing.
Figure 7:
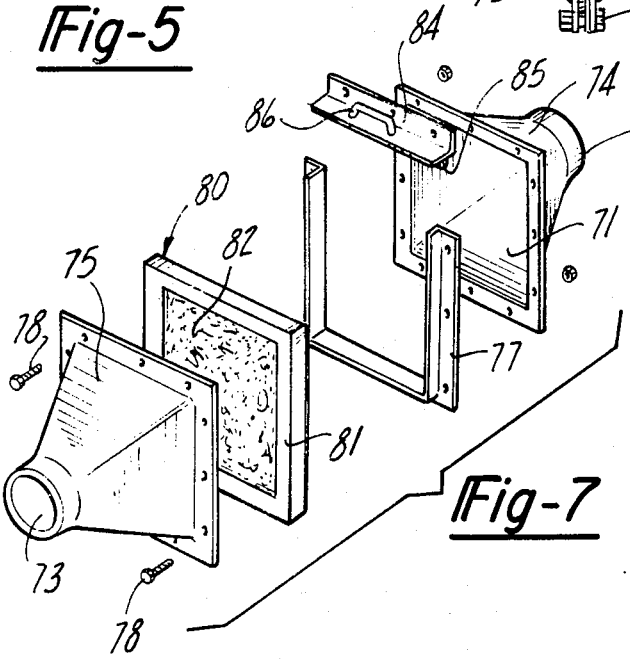
FIG. 7 is an exploded perspective view of the filter housing and filter cartridge.
Figure 8:
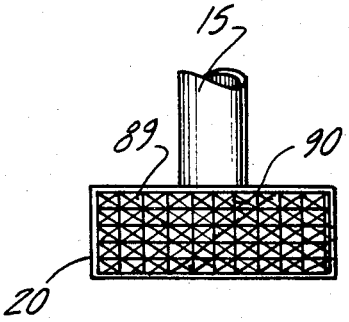
FIG. 8 is a bottom view of the vent hood assembly.

Filter units 19 and 27 are preferably provided in both the intake system 14 and exhaust system 22. As shown in FIGS. 6 and 7, each of the filter units includes a bifurcated filter housing 71. The filter housing 71 includes an inlet opening 72 on one end and an outlet opening 73 on the opposite end. The inlet opening being on the upstream end of the filter and the outlet opening being on the downstream end of the filter. The filter housing 71 includes an inlet half 74 and an outlet half 75. The inlet half 74 extends between the inlet opening 72 and a central frame 77 to create a plenum of air which allows a high efficiency, large cross-section filter to be used in the system. The outlet half 75 extends between the central frame 77 and the outlet opening 73 and functions as a funnel to direct the air after filtering back into the outlet opening 73. The inlet half 74 and outlet half 75 are secured to opposite ends of the central frame 77 by means of fasteners 78.

A filter cartridge 80 is mounted in the central frame 77 to be easily changed after foreign material accumulates in the filter. The filter cartridge includes a filter frame 81 and a filter element 82. The filter frame 81 is provided to retain the filter element in a rigid unflailing position when air flows therethrough. The filter element is a high efficiency filter preferably having an efficiency rating of 97.5% at 9 microns, 95% at 5 microns and 40% at 1 micron. A filter having this degree of efficiency is able to remove a high percentage of the bacteria, atmospheric dust and other micro contaminants found in ambient air. After filtering the air is much cleaner than air typically found inside buildings. The filter element has an enlarged cross-sectional area to permit air flow without undue restriction. Preferably the capacity of the filter is two to three times the cubic feet per minute capacity of the blower. For example and not by way of limitation, a typical filter used on a 400 cubic feet per minute system will have a maximum capacity of 1,100 cubic feet per minute. Such a filter is commercially available. One example, is a filter identified by the trademark Servodyn HE-40-6002.

The filter cartridge 80 is enclosed in the central frame 77 by a filter door 84. The filter door 84 includes a seal 85 about its periphery for preventing air from leaking into the filter housing around the filter door 84. The filter door 84 is preferably provided with a handle 86 for opening the filter door to remove the filter cartridge 80.

The vent hoods 20 and 28 are provided to protect the ends of the piping 15, 23 extending from the building 12. Each vent hood includes a primary screen 89 having a fine mesh, for example and not by way of limitation, of sixteen wires per square inch, which is effective to exclude insects from the system 10. A secondary screen 90 having a coarse mesh is also provided to support the primary screen 89 and to prevent entry into the cooling system 10 by rodents. Since the vent hoods are mounted outside the building 12 they are preferably constructed of galvanized metal to resist corrosion.

In operation, the cooling system 10 draws air into the enclosure 11 from outside the building 12 through the intake system 14. The blower 16 draws air from outside the building through the filter unit 19, into the blower 16, through the valve unit 17 (which is in its open position), and into the enclosure 11. As cool air is being drawn into the enclosure by the intake system, the exhaust system 22 is drawing warm air out of the enclosure 11 by means of the blower 24. The blower 24 draws the air from inside the enclosure, through the valve unit 25, into the blower 24 which forces the air through the filter unit 27 and vent hood 28 to the exterior of the building. Thus, warm air is removed from the enclosure 11 as the cold air is drawn from the outside of the building 12.

When the cooling system 10 is not operative, the blowers 16 and 24 are turned off and the valve units 17 and 25 of the intake system 14 and exhaust system 22 are in their closed position, thereby preventing passage of air through the intake system and exhaust system. The filter units 19 and 27 filter ambient air currents that exist in the piping 15 and 23 to remove foreign material therefrom. The prevents the operative portions of the cooling system 10 from becoming contaminated when not in use. Likewise, the vent hood assemblies 20 and 28 prevent entry of insects and rodents when the system is not operational.

If the system is to be used in a high humidity area it may be desirable to include condensate blowers 31 in both the intake and exhaust systems 14 and 22. The condensate blowers will be operated when the cooling system is not operational. The condensate blower 30 operates by drawing air through the shunt opening 31 in the piping and blowing it against the closed valve flap 61 to evaporate any condensation that may begin to form on that side of the valve. Condensation may also be avoided by heating the air in the condensate blower 30 to warm the surface of the valve flap 61 so that condensation does not form.

The supplemental cooling system is an energy saving device that operates entirely separately from existing refrigeration equipment when outside air temperature is sufficiently cool to assist in maintaining the enclosure temperature. The supplemental cooling system can reduce refrigeration costs by up to 90% in cool climates since when the system 10 operates only a blower is necessary to maintain the temperature of the enclosure. This eliminates the need to operate the refrigeration compresser which typically uses the largest portion of energy in a given refrigeration system.

The supplemental cooling system 10 of the present invention is safe and sanitary to use. Foreign material is prevented from entering the system by means of the filter units 19 and 27 and the vent hoods 20 and 28.

An accumulation of condensation in the cooling system 10 is prevented by adequately insulating the system and, in particular, insulating the valve units 17 and 25. In addition, a condensate blower 30 is disclosed which can eliminate condensation in the system when the cooling system 10 is not operational at the point the cool air from inside the enclosure is separated from the warm ambient air. By eliminating condensation, the accumulation of algae and bacteria is prevented by the system.

The foregoing is a complete description of a preferred embodiment of the present invention. Various changes and modifications may be made without departing from the present invention.

What is claimed is:

1. A cooling system for circulating ambient air through an enclosure comprising:

an intake system means for drawing cool air from a source of ambient air into an enclosure;

an exhaust system means for drawing warm air from the enclosure to exhaust the warm air into the source of ambient air;

first and second valve units being mounted in said intake system means and said exhaust system means respectively, said first and second valve units each comprising a housing having an inlet port for receiving air into the housing on one end, an outlet port on another end for allowing air to leave the housing, first and second valve elements, being moveable between an open position and a closed position wherein air flow through the housing is blocked in two spaced locations, said first valve element being disposed closer to the inlet port than said second valve element, said first and second valve elements when closed forming an insulating air pocket within the housing; and means for driving said first and second valve elements between the open and closed positions; and first blower means mounted adjacent the inlet port of the intake valve means for blowing warm air toward said first valve element when in the closed position to prevent the forming of condensation thereon, and second blower means mounted adjacent the outlet port of the exhaust valve unit for blowing warm air toward said second valve element when in the closed position to prevent the forming of condensation thereon.

2. In the cooling system of claim 1 wherein said first and second valve elements are two flaps pivotable about two spaced axes, said flaps being adapted to engage first and second valve seats respectively in the closed position of said valve.

3. In the cooling system of claim 2 wherein said first and second valve elements are made of polyvinyl chloride and are insulated with fiberglass to inhibit heat transfer therethrough and to prevent condensation from accumulating in said first and second valve units.

* * * * *